US006183166B1

(12) United States Patent
Schellhorn

(10) Patent No.: US 6,183,166 B1
(45) Date of Patent: Feb. 6, 2001

(54) METHOD OF CENTRIFUGALLY FORMING A SUBTERRANEAN SOIL-CEMENT CASING

(76) Inventor: Verne L. Schellhorn, 32987 Hwy. One South, Gualala, CA (US) 95445

( * ) Notice: Under 35 U.S.C. 154(b), the term of this patent shall be extended for 0 days.

(21) Appl. No.: 09/283,483

(22) Filed: Apr. 1, 1999

(51) Int. Cl.[7] ..... E02D 5/30; E02D 5/62; E02D 5/56

(52) U.S. Cl. ..... 405/233; 405/236; 405/240; 405/241

(58) Field of Search ..... 405/240, 241, 405/242, 233, 267, 269, 232, 237, 238

(56) References Cited

U.S. PATENT DOCUMENTS

| | | | | |
|---|---|---|---|---|
| 3,206,936 | * | 9/1965 | Moor | 405/237 X |
| 3,255,592 | * | 6/1966 | Moor | 405/237 X |
| 3,391,544 | * | 7/1968 | Daczko | 405/237 X |
| 4,601,613 | * | 7/1986 | Wolf | 405/240 X |
| 4,786,212 | * | 11/1988 | Bauer et al. | 405/241 X |
| 4,958,962 | * | 9/1990 | Schelhorn | 405/269 X |
| 5,279,502 | * | 1/1994 | Goughnour | 405/240 X |
| 5,304,016 | * | 4/1994 | Kunito | 405/233 |
| 5,378,085 | * | 1/1995 | Kono et al. | 405/241 X |
| 5,738,465 | * | 4/1998 | Gessay et al. | 405/233 X |

FOREIGN PATENT DOCUMENTS

| | | | | |
|---|---|---|---|---|
| 0161974 | * | 11/1985 | (EP) | 405/241 |
| 27594 | * | 12/1912 | (GB) | 405/240 |

* cited by examiner

*Primary Examiner*—Dennis L. Taylor
(74) *Attorney, Agent, or Firm*—Bruce H. Johnsonbaugh

(57) ABSTRACT

A method is provided for centrifugally forming a subterranean, cylindrically shaped soil-cement casing in material located in a subterranean earth situs. A soil processing tool is advanced and rotated into the subterranean situs and as the tool advances a high velocity cement slurry is introduced through said tool to hydraulically divide the pieces of soil into particles and to mix the cement slurry with the particles to form a soil-cement slurry. As the soil processing tool is then withdrawn from the situs, the tool is rotated at a speed to exert a centrifugal force by the tool on the soil-cement slurry in excess of two G's, causing the solids of the soil-cement slurry to migrate away from the center of the hole to form a first cylindrical region at the edge of the hole and a second cylindrical region at the center of the hole. The first region has more of the dense solids and the second internal region has a greater proportion of free water and less of the dense solids. The mixture in the hole is then allowed to setup, leaving the soil-cement casing at the outer region of the hole.

10 Claims, 15 Drawing Sheets

METHOD OF CENTRIFUGALLY FORMING A SUBTERRANEAN SOIL-CEMENT CASING

BACKGROUND AND BRIEF SUMMARY

The present invention relates generally to subterranean or underground construction techniques. More particularly, the present invention provides a method of efficiently forming a subterranean soil-cement casing. The casing may be used for a variety of purposes, including the insertion of reinforced high strength concrete into the casing.

It is known in the prior art to provide hollow cylindrical steel casings in a subterranean environment for a variety of purposes. These steel casings are typically hoisted and inserted into the hole on a piece-by-piece basis. The cost of installing underground steel casings can be extremely high and time consuming.

It is also known in the prior art to provide homogeneous, solid soil-cement support columns formed by a soil processing tool which utilizes high velocity cement slurry to create a soil-cement mixture. U.S. Pat. No. 4,958,962 teaches such a method.

There is a substantial need for underground casings which can be installed more quickly and less expensively than conventional steel casings. The present invention addresses that need and provides an underground casing comprised of a soil-cement mixture which can be formed much more quickly and much mare inexpensively than conventional steel casings. The present invention is an improvement over the methods disclosed in U.S. Pat. No. 4,958,962. The primary improvement over that patent is that the soil processing tool is vigorously rotated as it is removed from the hole, causing solids in the soil-cement slurry to migrate to the outer edges of the hole, so that the outer region of the mixture has a smaller proportion of free water. The denser solids include the relatively high strength cementitious solids and solid particles that form a much harder soil-cement mixture along the outer edges of the hole as compared with the center region. The lighter particles and water tend to remain in the center of the hole. The soil-cement column is allowed to set up and the soft center region is preferably drilled out, leaving the relatively hard and strong soil-cement casing in place. The hollow soil-cement casing may, in some forms of the invention, be filled with reinforced, high strength concrete. In other forms of the invention, the soft center region is left in place and not drilled out.

A primary object of the invention is to provide a method for producing underground cylindrical casings relatively quickly and inexpensively.

A further object of the invention is to provide a subterranean soil-cement casing which may or may not have its interior filled with reinforced high strength concrete.

Yet another object of the invention is to provide a method for forming subterranean soil-cement casings which may be of large diameter, i.e. greater than 20 feet diameter, great depth, more than 200 feet, and simultaneously having relatively large wall thickness, i.e. greater than 1 foot.

Other objects and advantages of the invention will become apparent from the following description and drawings, wherein:

DETAILED DESCRIPTION OF THE DRAWINGS

Figure 1:
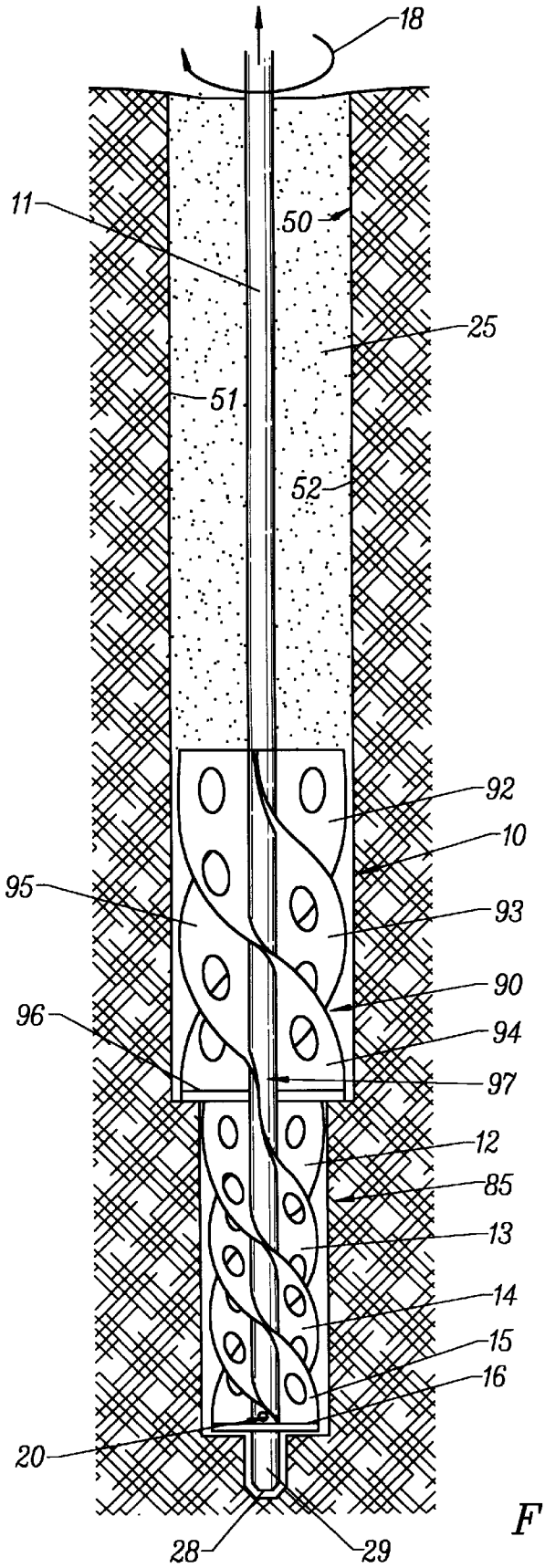
FIG. 1 is a schematic representation showing the first step of the method according to the present invention wherein a soil processing tool has been advanced into the underground situs and the hole is filled with a soil-cement slurry mixture.

As shown in FIGS. 1–4, a soil processing tool 10 is provided having a hollow stem 11, a first stage 85 and second stage 90. First stage 85 has four helical flights 12,13,14 and 15 and cutting tip 16. Cutting tip 16 typically has cutting teeth known in the art; cutting teeth are not shown in the drawings for clarity. Helical flights 12–15 are preferably as shown and described in greater detail in FIG. 12 of U.S. Pat. No. 5,396,964, owned by the assignee of the instant application. U.S. Pat. Nos. 5,396,964; 4,793,740 and 4,958,962 are hereby incorporated by reference as if set forth in full. The second stage 90 has four helical flights 92,93,94 and 95. The outer diameter of helical flights 12–15 of the first stage 85 is smaller than the outer diameter of helical flights 92–95 of second stage 90. The second stage 90 has a wear resistant cutting surface 96 similar to cutting tip 16 and nozzle 97 through which cement slurry is pumped.

Nozzle means 20 is located near cutting tip 16 and allows the introduction of a cement slurry under pressure which combines with the soil being dug by rotation of tool 10. The cement slurry is preferably a mixture of Portland cement and water having a density of greater than 12.0 pounds per gallon. Greater densities of the cement slurry can be achieved by utilizing more Portland cement. Greater densities of the cement slurry are required where the soil is relatively dense. As described in greater detail in U.S. Pat. Nos. 4,793,740; 4,958,962 and 5,396,964, the cement slurry is introduced as high pressure jets to achieve velocities of 300 ft/sec to 2500 ft/sec. The jets are sufficiently strong to reduce pieces of soil created by the auger to particles small enough to form a mixture with the cement slurry. It is to be understood that in FIGS. 1 and 2, the soil-cement mixture 25 extends to the bottom of hole 50.

The present methodology of advancing the soil processing tool or auger 10 and breaking the soil into particles is preferably as shown in greater detail in U.S. Pat. No. 4,958,962. As shown in FIG. 1, the tool 10 is rotated in the clockwise direction as shown by arrow 18 as the tool is being driven downwardly into hole 50.

A pilot bit 29 is connected to the lowermost end of hollow stem 11. The pilot bit preferably has a nozzle 28 formed in its lower tip; the pilot bit providing directional stability for the tools that follow. The helical flight design of the tool 10 shown in FIGS. 1–4 is not intended to convey material upwardly, as is the auger 9 shown in FIG. 6. The helical design of FIGS. 1–4 is to provide lateral stability which, together with the pilot bit 29, prevents chatter.

Figure 2:
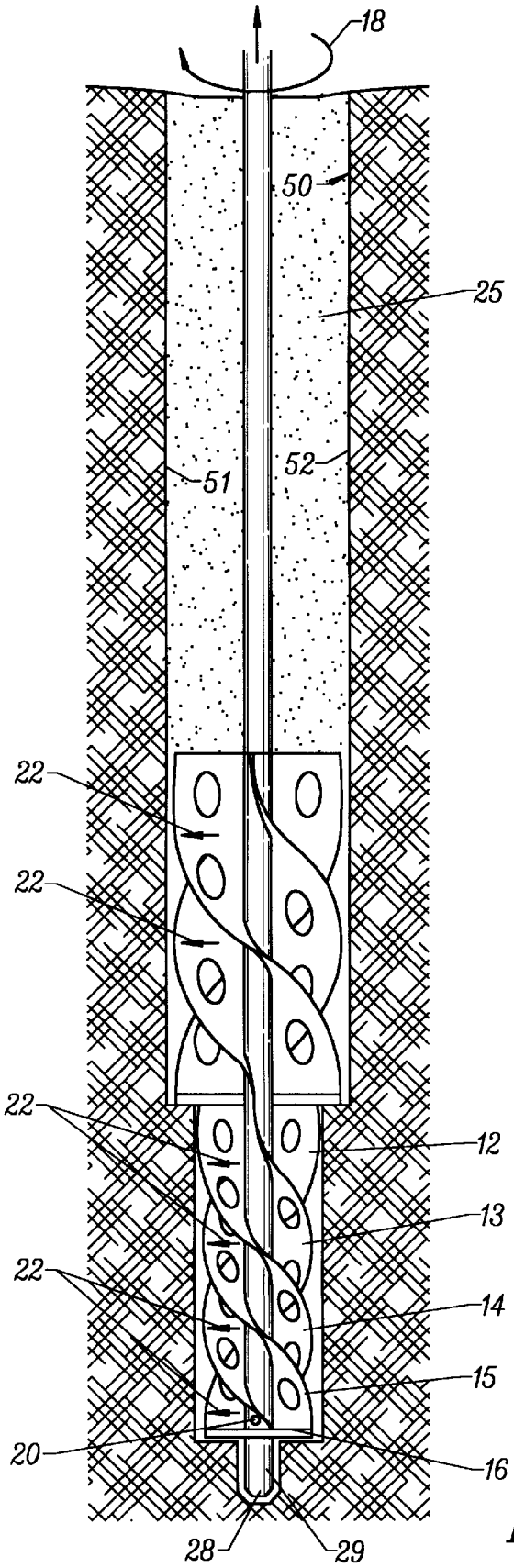
FIG. 2 is a schematic representation of the second step of the present method wherein the soil processing tool is vigorously rotated, causing the denser solids to migrate toward the outer edges of the hole.
Figure 11:
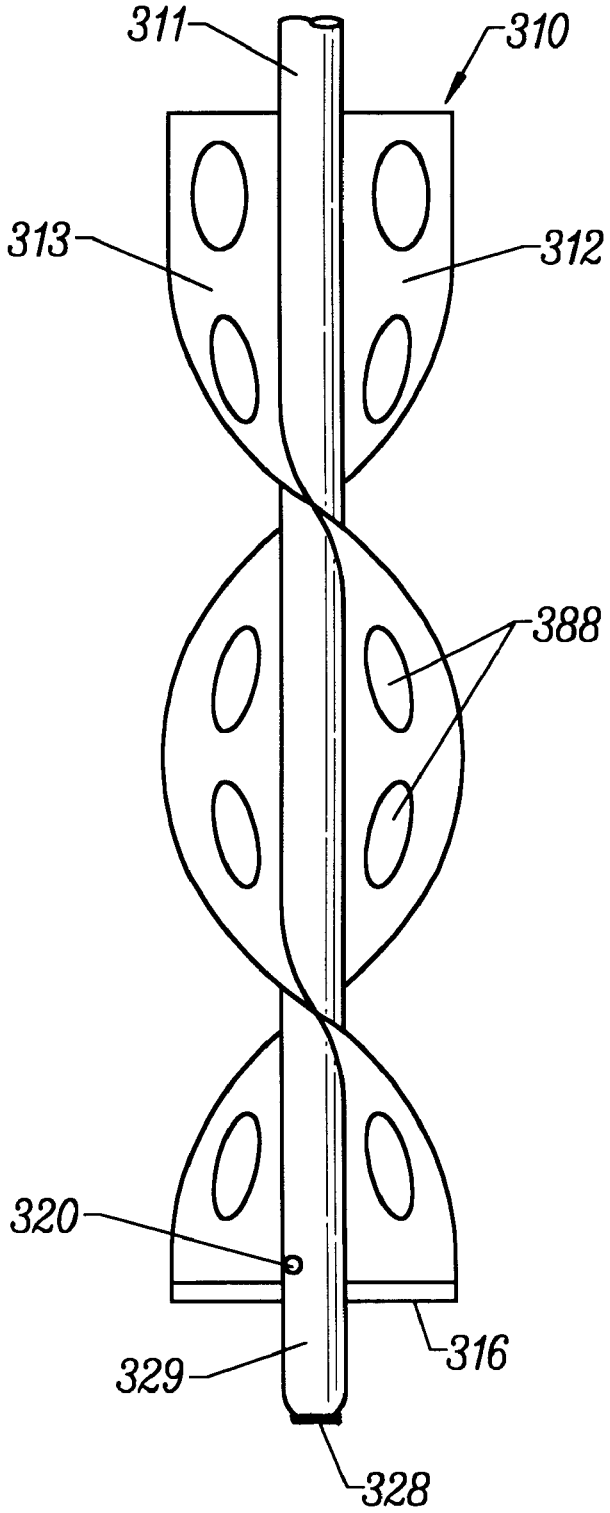
FIG. 11 shows another soil processing tool for use in the present invention.

In accordance with the present invention, when the proper depth of hole 50 has been achieved, as shown in FIGS. 1 and 2, the tool 10 is rotated vigorously in either direction. As shown in FIG. 2, the auger-shaped tool 10 is rotated in a clockwise direction as shown by arrow 18 as it is being lifted upwardly out of hole 50. The tool is rotated at a sufficiently high speed to generate a force of two G's or more along the outer edge of flights 12–15 of first stage 85. Those centrifugal forces tend to drive the denser cementitious and soil particles towards the outer edges or side walls 51 and 52 of hole 50 into the annular region 31 between first stage 85 and side walls 51 and 52, as shown schematically by arrows 22 in FIG. 3. Rotational speeds for tools of various diameters to achieve two G's are shown in FIG. 11 of U.S. Pat. No. 5,396,964.

Figure 3:
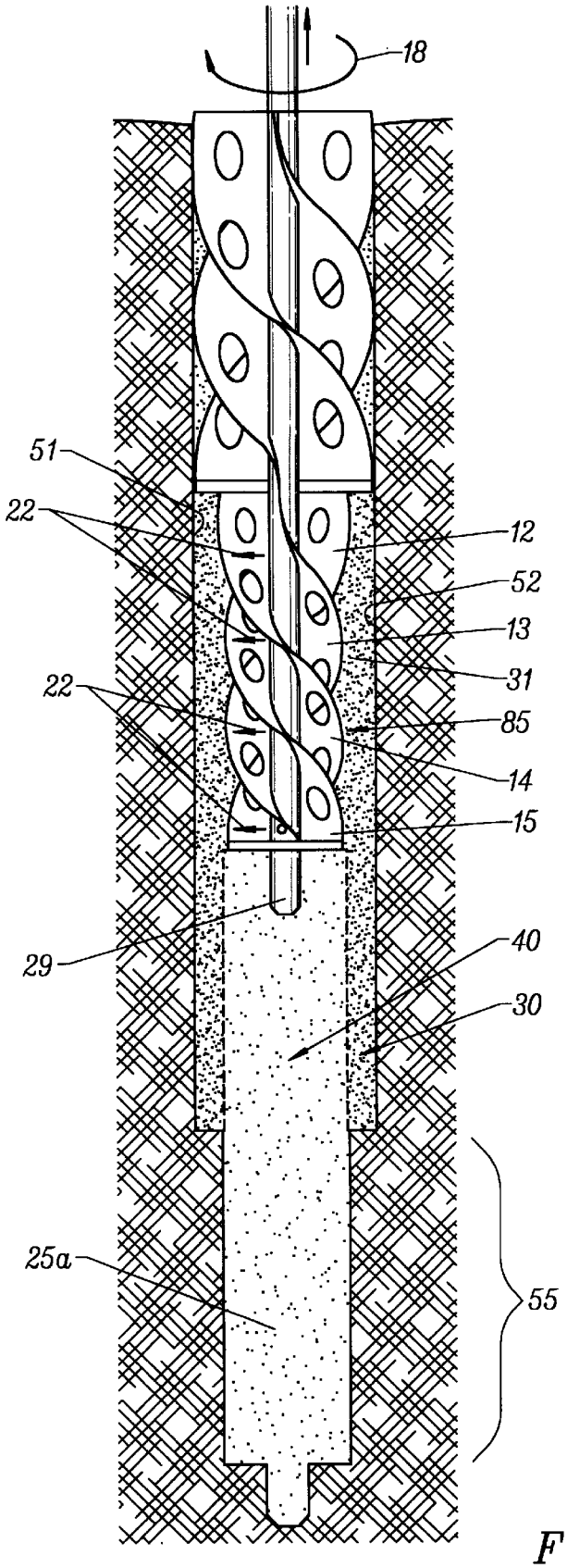
FIG. 3 shows the soil processing tool as it is being withdrawn to the upper portion of the hole and wherein the relatively dense solids have formed along the outer edges of the lower portion of the hole.

As shown in FIG. 3, as the auger-shaped tool 10 is being withdrawn and vigorously rotated, a first cylindrical region 30 is formed at the outer edges of hole 50 which contains a relatively high proportion of the denser soil and cementitious solids and a smaller proportion of free water compared to the lighter soil particles and free water that remain in the second central region 40. The second cylindrical region 40 is simultaneously formed at the center of hole 50 and has a greater proportion of free water and is softer than the first region 30. When the auger-shaped tool is rotated as shown in FIG. 3, at a sufficient rotational speed to cause in excess of two G's at the outer diameter of first stage flights 12–15, and if the cement-slurry is approximately 20% of the volume of hole 50, the eventual strength of the first region 30 in sandy soil is approximately 1,000 psi and the resultant strength of the second region 40 is approximately 200 psi.

The smaller diameter of the first stage 85 serves to form an annulus 31 (FIG. 3) between first stage 85 and side walls 51 and 52 of hole 50, which allows the undisturbed accumulation of centrifugally placed denser solids which ultimately form the soil-cement casing of the present invention. The smaller diameter first stage is intended to maximize the separation of denser cementitious and soil particles from lightweight soil particles and water.

The length of first stage 85 may vary from approximately 10% to 100% of the length of second stage 90 depending on soil-type, removal rpm, withdrawal rate and overall design requirements. The lowermost portion 55 of the hole 50 should be considered sacrificial as its function is to accommodate the length of the first stage 85. The lowermost portion 55 of the hole 50 formed by first stage 85 does not have the casing of the present invention formed along its sides. However, the soil-cement mixture 25*a* that remains in this portion of the hole acts as a plug to prevent moisture from entering the casing formed by region 30, as shown best in FIG. 7.

By rotating the tool vigorously as it is being withdrawn, the soil-cement is subjected to an additional mixing cycle compared with the prior art methods referred to above. Furthermore, the additional mixing cycle, together with accelerating and driving the heavier particles outwardly, creates a homogeneous high strength soil cement casing wall. This casing wall will have a superior interface with the original soil side walls, in that the cementitious particles will form a denser matrix with the original soil side walls. The resulting casing wall has several advantages compared with the prior art: First, the casing wall has less water and consequently greater strength. Second, the casing wall will have lower permeability to water and chemicals. Third, the casing wall will have greater homogeneity. Fourth, the casing wall will have greater shear strength between the exterior surface of the casing and the original soil side walls. Fifth, the casing wall will be harder than the interior cylindrical region 40, so that as region 40 is being drilled out, the casing wall tends to center the drilling tool.

As the tool is being withdrawn from the hole, it is advisable to continue to pump cement-slurry through the nozzles at low pressure to prevent the nozzles from becoming clogged.

Figure 4:
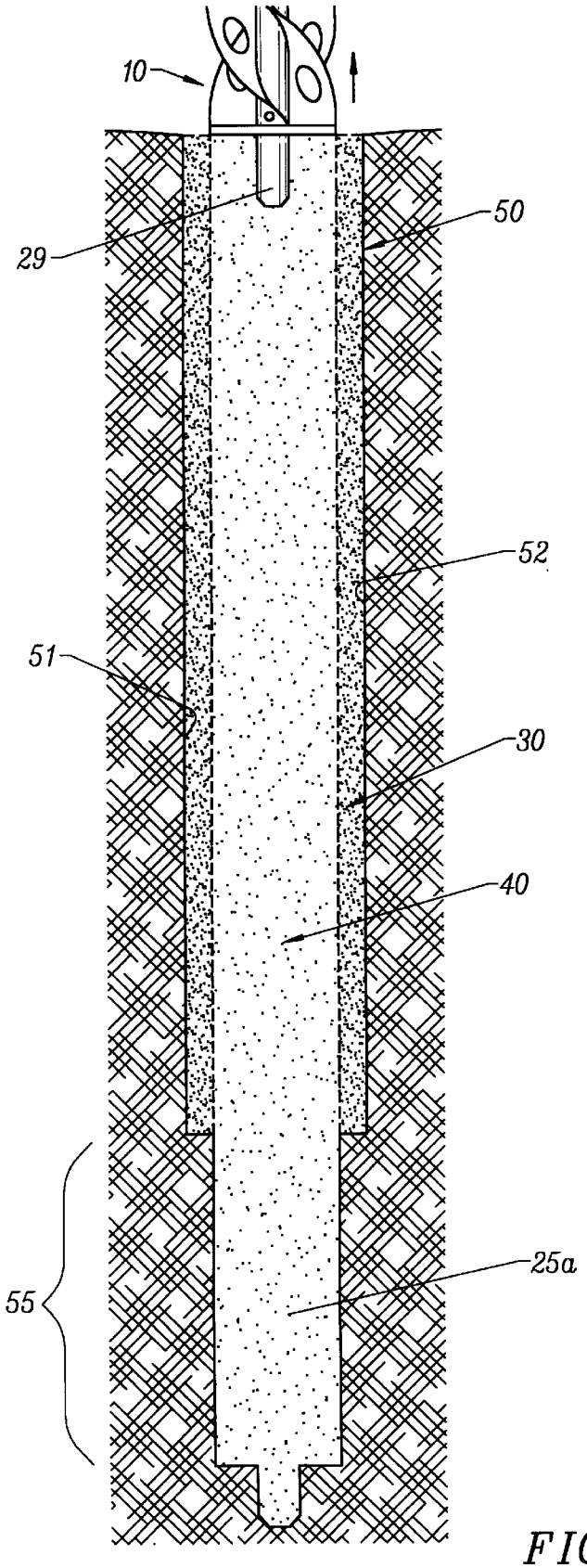
FIG. 4 shows the soil processing tool removed from the hole and showing the relatively dense solids forming a relatively high strength soil-cement mixture along the outer edges of the hole and a lighter, less strong soil-cement mixture forming a weaker region in the center of the hole.
Figure 5:
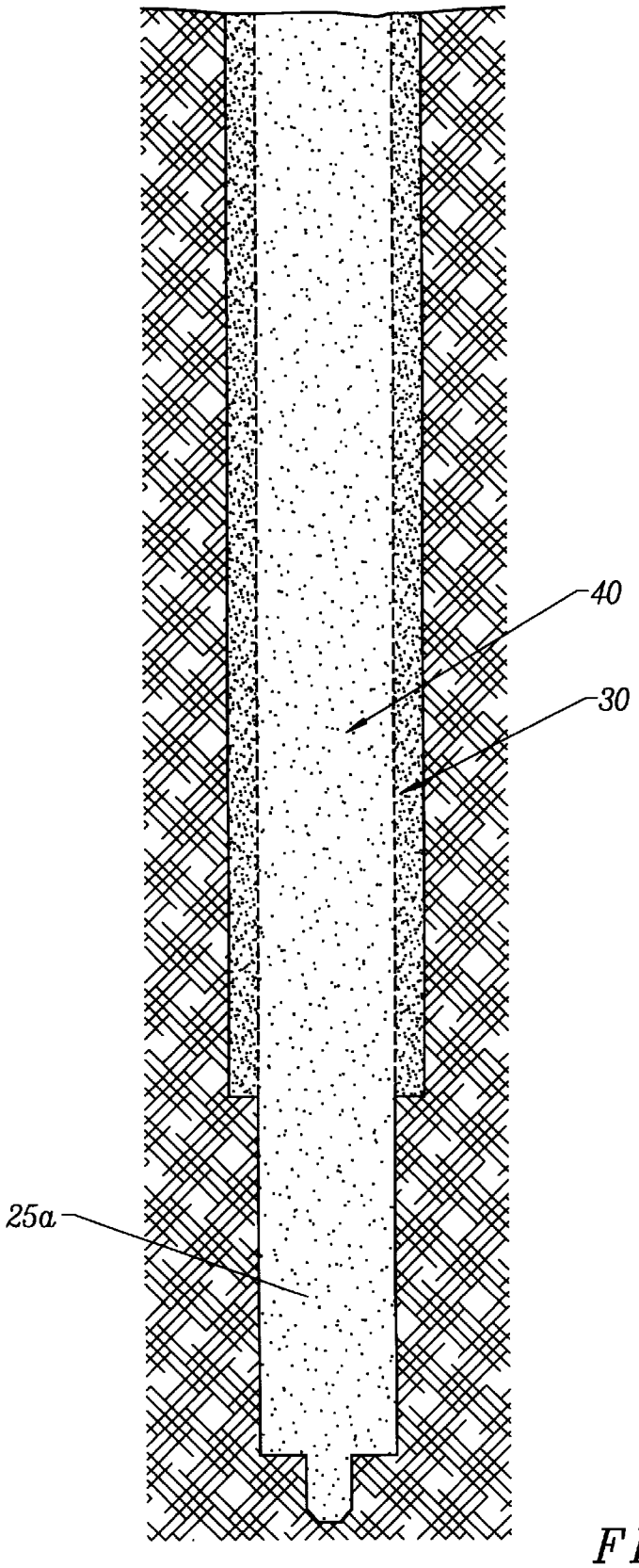
FIG. 5 shows the hole after the tool has been removed and after the soil-cement mixture has set up.
Figure 6:
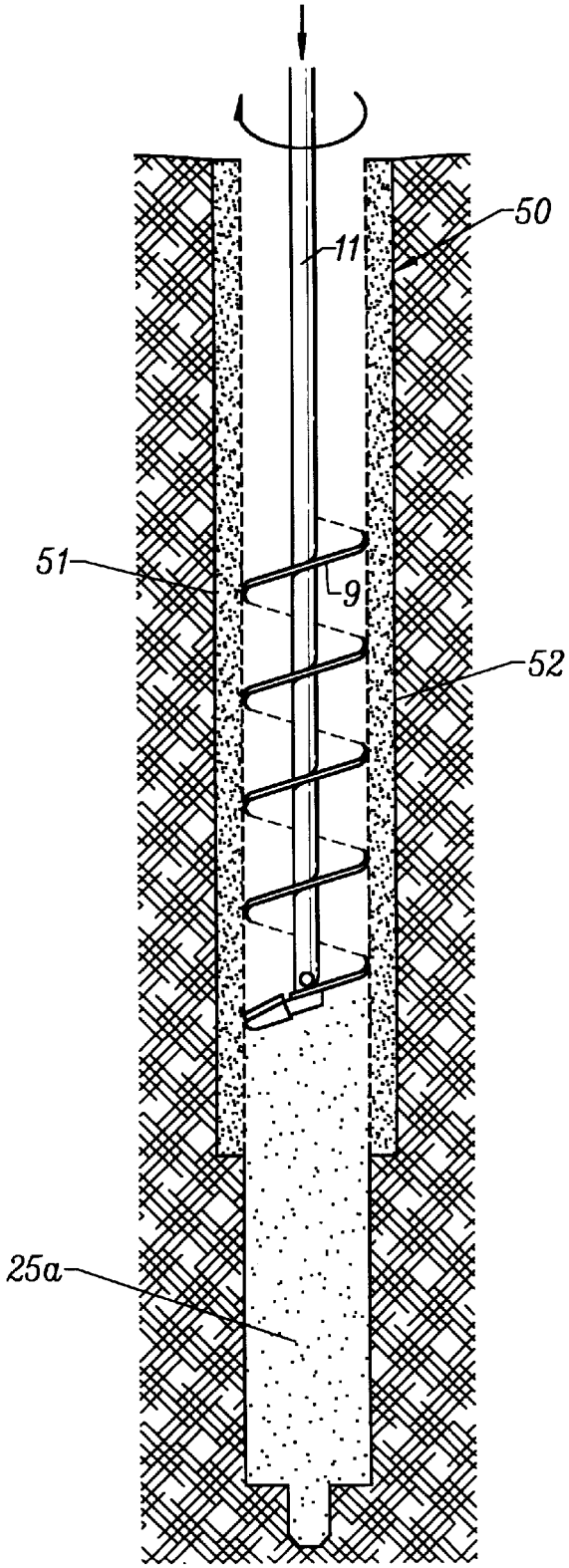
FIG. 6 shows the next step of the present invention wherein after the underground mixture has been allowed to set up, the soft central portion is being drilled out and removed.
Figure 7:
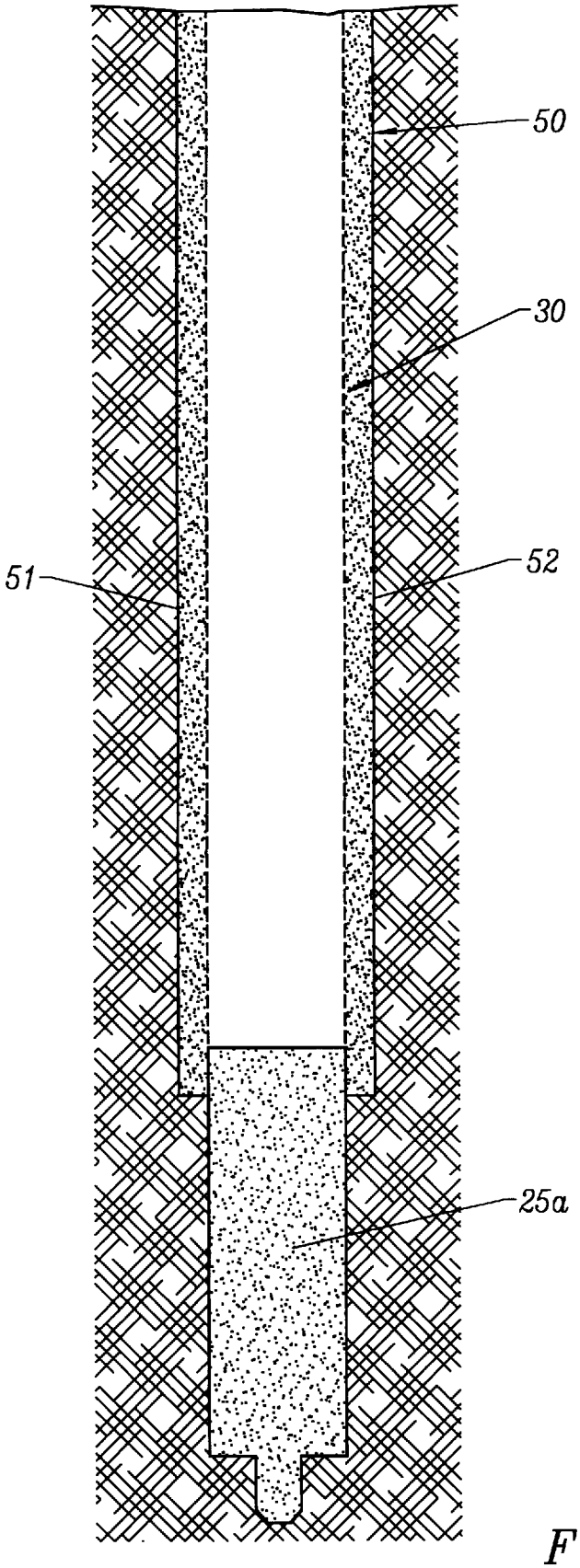
FIG. 7 shows the resulting subterranean cylindrically shaped soil-cement casing after the soft central portion has been removed.

FIG. 4 shows the tool 10 after it has been removed completely from hole 50. The soil-cement mixture in the first region 30 and second region 40 are allowed to dry and harden. FIG. 5 shows the soil-cement mixture in hole 50 after it has set up. As shown in FIG. 6, a smaller auger 9 is utilized to drill into and remove the softer soil-cement mixture from second region 40. Auger 9 will tend to remain centered in region 40 because the harder soil-cement in first region 30 keeps it centered. After removal of the soil-cement mixture from the second region 40, a resultant subterranean cylindrical and hollow casing 30 remains in place as shown in FIG. 7. The hollow casing comprises the hardened soil-cement mixture in first region 30.

It is also within the scope of the invention to leave the soft center region 40 in place and to not drill it out, as shown in FIG. 5. In this embodiment, the casing 30 is high strength, relatively impermeable to water and chemicals, and would have a variety of end uses.

It is significant to note that the underground soil-cement casing 30 can be formed in a wide variety of diameters, depths and wall thicknesses according to the present invention. For example, the diameter of hole 50 can be 20 feet and in some instances even greater. The wall thickness of casing 30 can essentially be of any thickness desired, providing that the economics of the situation allow for extensive use of cement. The use of prior art steel casings puts definite limitations on the wall thickness of the casing, determined by manufacturing limitations as well as transport and handling limitations in lowering the steel casing segments into the hole 50. It is also significant to note that the vertical depth of the casing according to the present invention is only limited by available drilling rigs and augers.

Figure 8:
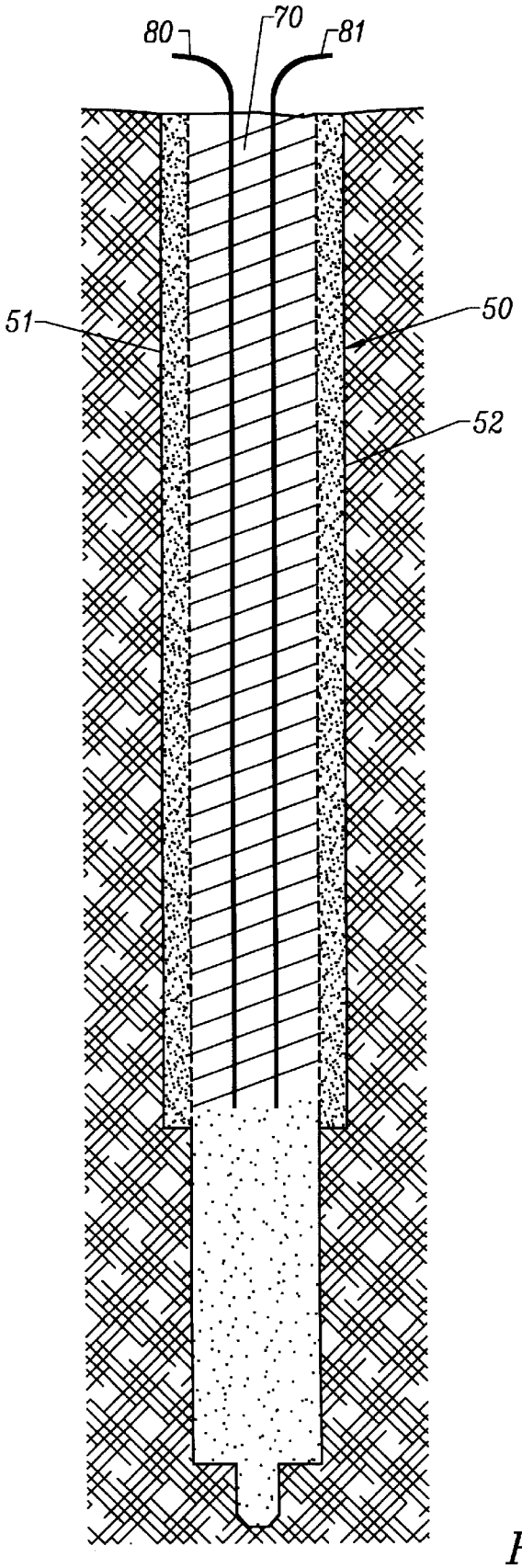
FIG. 8 shows the subterranean soil-cement casing of the present invention after it has been filled with high strength reinforced concrete.

FIG. 8 shows the optional installation of high strength concrete 70 along with reinforcing members 80 and 81. Various surface structures may be supported by the reinforced high strength concrete column 70.

FIGS. 9–12 show various alternate embodiments of soil processing tools for use in the present invention.

Figure 9:
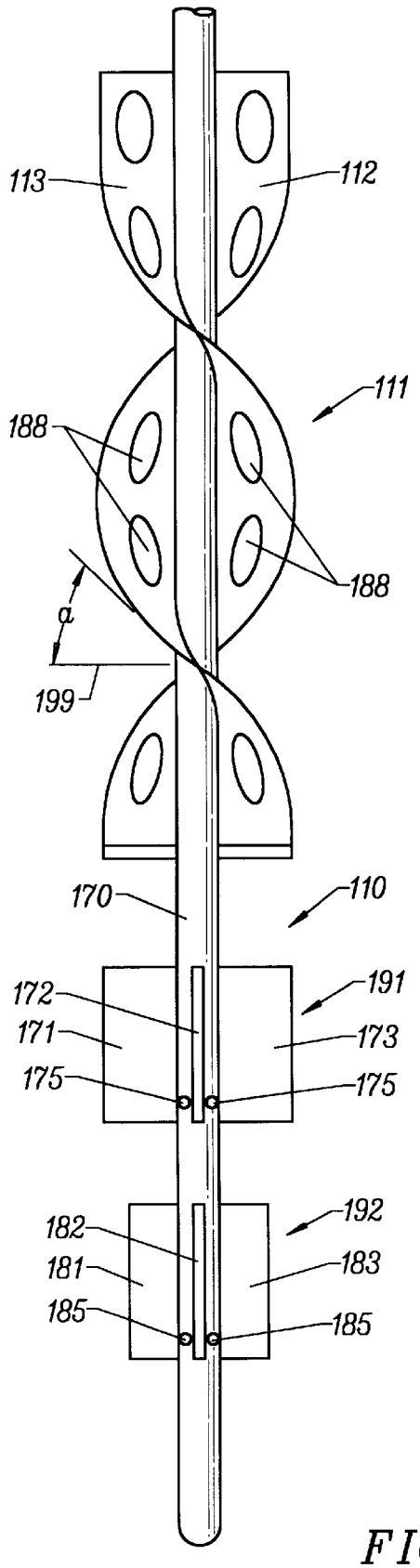
FIG. 9 shows an alternate soil processing tool for use in the present invention.

FIG. 9 shows an alternate tool 110 for use with the present invention. Tool 110 includes a helical segment 111 with two flights 112 and 113, as well as sections 191 and 192. Each of the flights 112,113 has a pitch angle "a" relative to a horizontal axis 199 of between 45° and 90°. Each flight also preferably has a series of openings 188 formed therein to increase its mixing capacity. Tool 110 also includes two cutting and mixing sections 191 and 192. Section 191 has four flat vertical blades 171,172,173 and 174 (not visible in FIG. 9) and four high pressure nozzles 175 extending perpendicularly outward from central shaft 170. Section 192 is positioned at the lowermost end of the tool string and has four flat vertical blades 181,182,183 and 184 (not visible in FIG. 9) connected to hollow shaft 170. Nozzles 185 are positioned to inject slurry under pressure. The primary function of section 192 is to propel the cementitious and denser soil solids horizontally outwardly as the tool 110 is rotated vigorously. Section 192 forms is a "first stage" of tool 110 and has a reduced outer diameter compared to section 191 and helical flights 112 and 113. Section 192 centrifugally casts the denser solids into the annulus between vertical blades 181–184 and the side walls 51 and 52 of hole 50 similar to first stage 85 of FIGS. 1–3.

Figure 10:
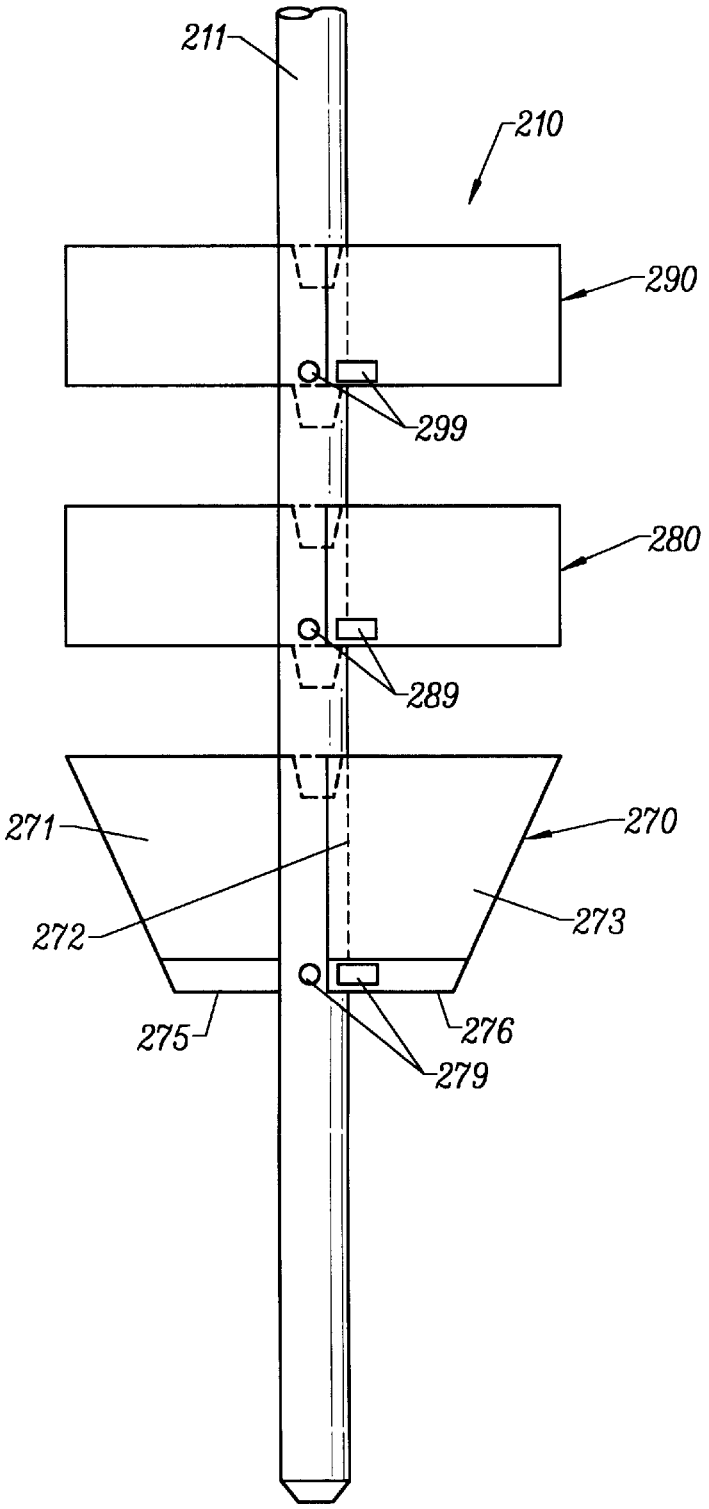
FIG. 10 shows yet another alternate soil processing tool for use in the present invention.

FIG. 10 shows a third type of soil processing tool 210 for use in the invention. Tool 210 includes three separate sections 270, 280 and 290. Each section has four identical vertical blades extending perpendicularly from shaft 211 and all have the same outer diameter. The lowermost section 270 includes four tapered blades, three of which are visible in FIG. 10, i.e. 271, 272 and 273. Each tapered blade has a reduced diameter at its lowermost cutting edge, such as edges 275 and 276 of blades 271 and 273. The purpose of the taper is to provide a tapered region between section 270 and the sides of the hole so that as tool 210 is withdrawn, the tapered region allows the denser solids to accumulate undisturbed by section 270. Each section 270, 280 and 290 has a plurality of nozzles 279, 289 and 299 to introduce cement slurry.

FIG. 11 shows a fourth type of soil processing tool 310 for use with the invention. This embodiment utilizes two helical flights 312 and 313 carried by shaft 311. A plurality of openings 388 is formed in each flight. Cutting tip 316, nozzle 320, pilot bit 329 and pilot nozzle 328 are similar to those shown in FIGS. 1–3. The tool 310 uses only a single stage comprising flights 312 and 313, compared with the two stage design of FIGS. 1–3 wherein one stage has a reduced diameter.

Figure 12:
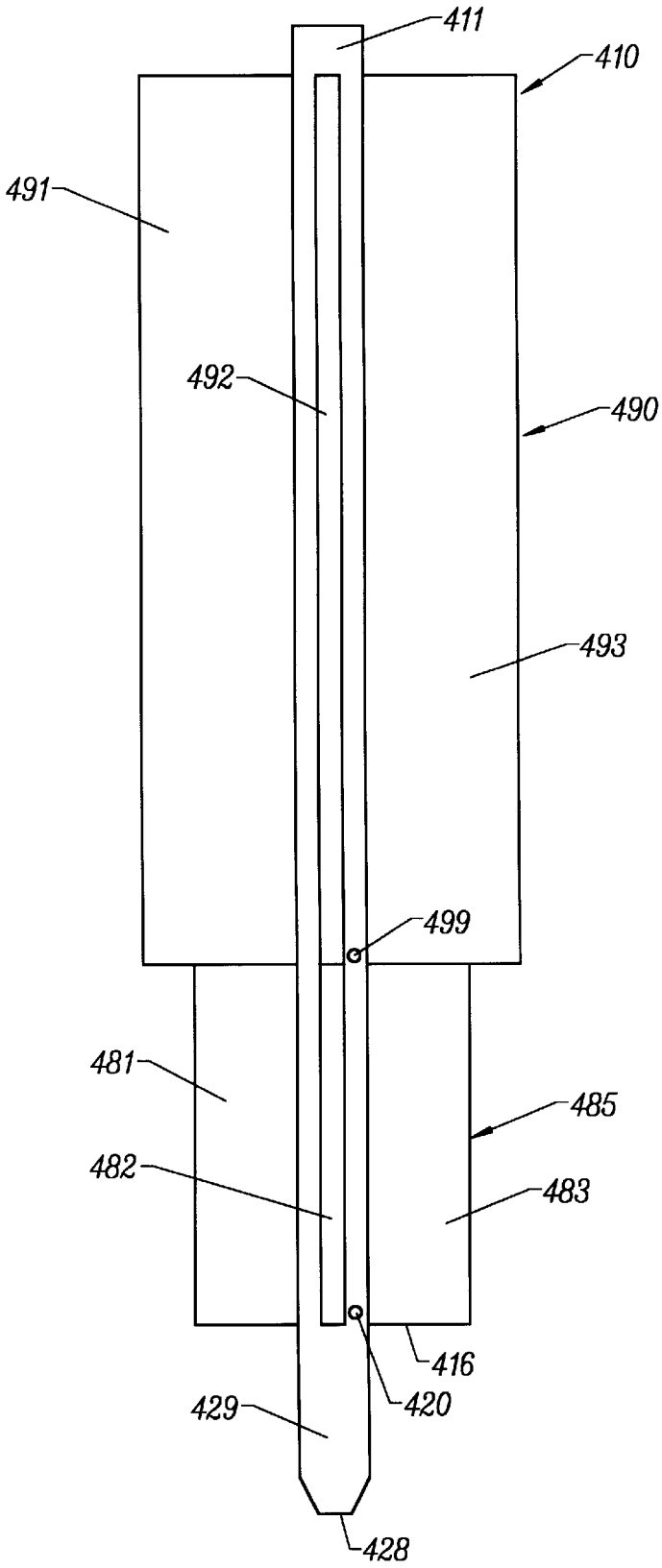
FIG. 12 shows yet another soil processing tool for use in the present invention.

FIG. 12 shows a fifth embodiment of a soil processing tool 410 for use in the invention. Tool 410 includes first stage 485 of reduced diameter having a plurality of four vertical blades, three of which are shown in FIG. 12 as 481, 482 and 483. A plurality of nozzles 420 is provided to introduce high velocity cement slurry as cutting edges 416 rotate. A second stage 490 is carried above first stage 485 by shaft 411. Second stage 490 includes four vertical blades, three of which are shown in FIG. 12 as 491, 492 and 493. A plurality of nozzles 499 is provided at the lower edge of second stage 490. Pilot bit 429 has a nozzle 428 at its tip.

Figure 13:
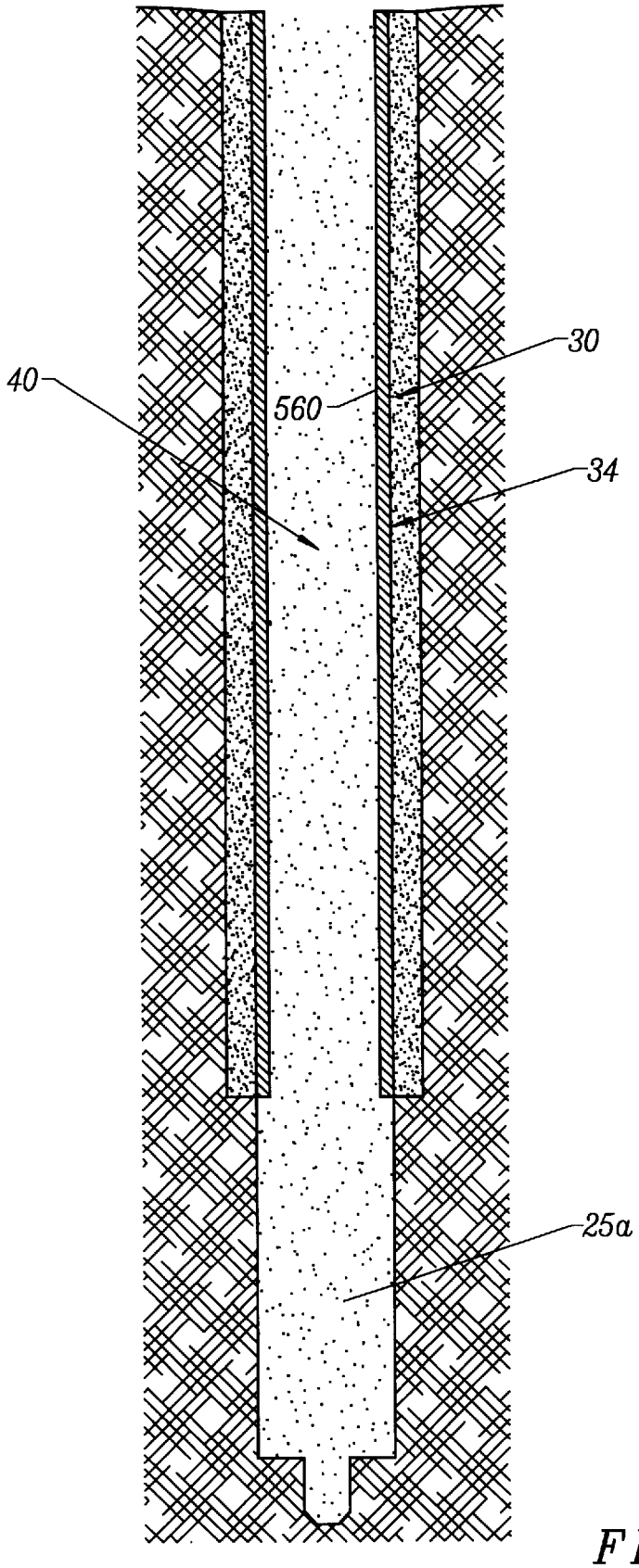
FIG. 13 shows an alternate form of the invention wherein a pipe has been inserted into the soil-cement mixture of FIG. 4 prior to setting up of the mixture.

FIG. 13 shows an open ended pipe 560 inserted into the hole 50 prior to set up of the soil-cement mixture in regions 30 and 40 as shown in FIG. 4. Pipe 560 may be steel, plastic or other material. The purpose of pipe 560 is to provide a secondary casing that interfaces with the inner diameter 34 of soil-cement casing 30 to offer additional structural support laterally and vertically. Pipe 560 provides corrosion resistance, and increased impermeability.

Figure 14:
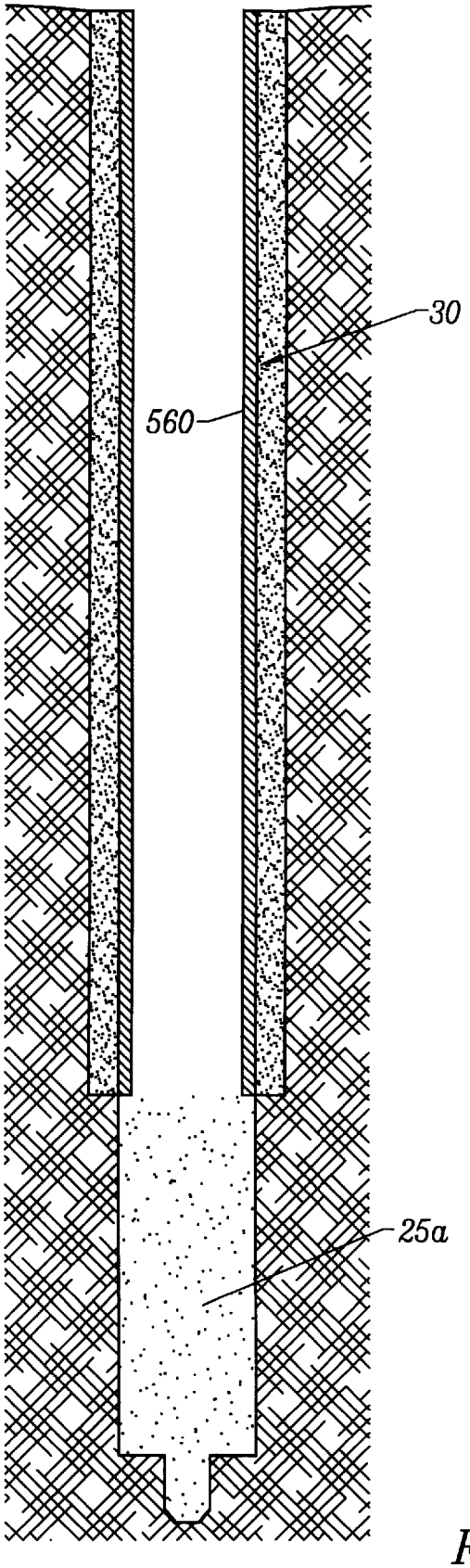
FIG. 14 shows the form of the invention shown in FIG. 13 wherein the mixture inside the pipe has been drilled out.
Figure 15:
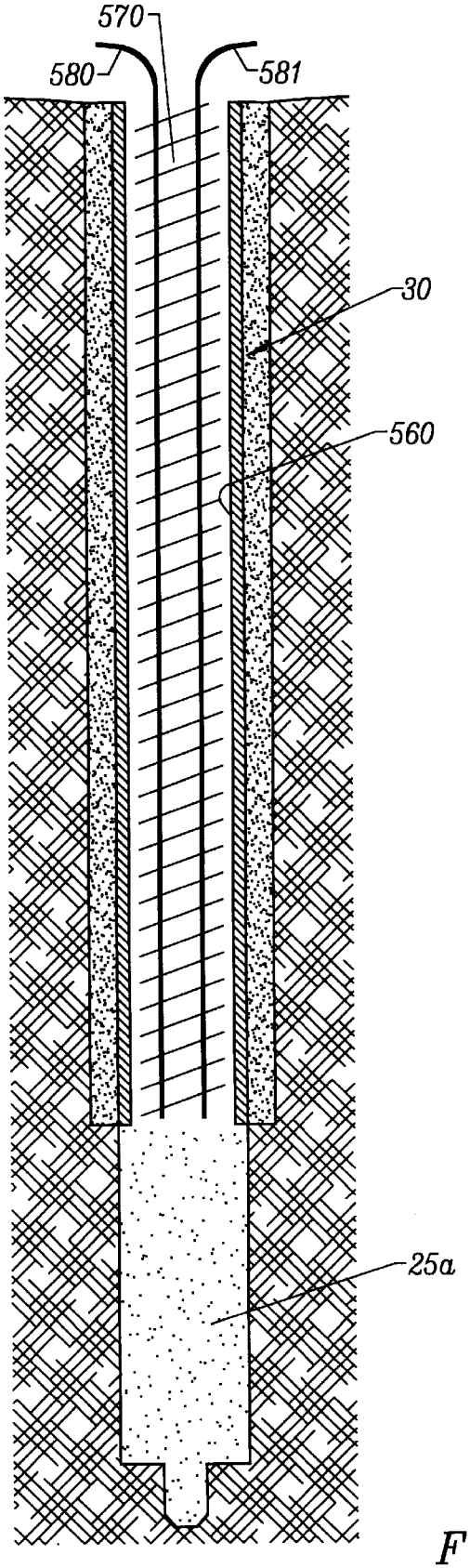
FIG. 15 shows the placement of high strength, reinforced concrete into the drilled out pipe shown in FIG. 14.

As shown in FIGS. 14 and 15, the relatively weak soil-cement mixture inside pipe 560 may be drilled out (FIG. 14) and replaced with high strength concrete 570 with or without reinforcing bars 580 and 581 as shown in FIG. 15.

It is also possible to insert structural elements other than open ended pipe into the soil-cement mixture of FIG. 5 before the mixture sets up. For example, H beams or I beams may be inserted.

The velocities with which the cement slurry is injected are typically in the range of 300 ft/sec to 2500 ft/sec. However, in sandy soils, and especially in "sugar-like" sand, velocities as low as 100 ft/sec are sufficient.

It is to be understood that other soil processing tool designs may be utilized without departing from the spirit of the invention.

It is also to be understood that the present invention may be utilized to produce patterns of subterranean casings for a variety of purposes. For example, a series of casings may be drilled adjacent each other along a predetermined line to form an underground wall or barrier, as well as a variety of other end purposes.

What is claimed is:

1. A method for centrifugally forming a subterranean, cylindrically shaped soil-cement casing in material located in a subterranean earth situs, comprising the steps:

advancing and rotating a soil processing tool into said situs to break said material into pieces, said soil processing tool forming a hole as it advances;

while advancing said soil processing tool into said situs, introducing a cement slurry into said pieces from said tool at a velocity sufficient to hydraulically divide said pieces into particles and mix said cement slurry with said particles to form a soil-cement slurry, said soil-cement slurry containing cementitious solids, soil particles and free water;

withdrawing said soil processing tool from said situs;

while withdrawing said soil processing tool, rotating said tool at a rotational speed to exert a centrifugal force by said tool upon said soil-cement slurry in excess of two G's, whereby said centrifugal force causes the solids of said soil-cement slurry to migrate further from the center of said hole than said free water to form a first cylindrical region at the outer edges of said hole and a second cylindrical region at the center of said hole, said first region having a smaller proportion of free water than said second region; and allowing said mixture in said hole to set up.

2. The method of claim 1 further comprising the step:

drilling out and removing said second region, leaving in place said first region forming a subterranean soil-cement casing.

3. The method of claim 2 further comprising the step:

inserting reinforced, high-strength concrete into said subterranean soil-cement casing.

4. The method of claim 1 wherein said cement slurry is a mixture of Portland cement and water.

5. The method of claim 4 wherein said Portland cement and water slurry having a density of greater than 12 pounds per gallon.

6. The method of claim 1 wherein said soil processing tool has first and second stages, said first stage having an outer diameter less than said second stage, and wherein said first stage is mounted below said second stage.

7. The method of claim 6, wherein said first and second stages each are helical augers.

8. The method of claim 7, wherein said first and second stages each are helical augers having two or more flights.

9. The method of claim 1 further comprising the step:

inserting a structural element into said hole after withdrawing said soil processing tool but prior to allowing said mixture in the hole to set up.

10. The method of claim 9 wherein said structural element is an open ended pipe.

* * * * *